US006237779B1

(12) United States Patent
Boyer

(10) Patent No.: US 6,237,779 B1
(45) Date of Patent: May 29, 2001

(54) UTENSIL SORTING APPARATUS

(76) Inventor: Jay M. Boyer, 1250 S. 900 East, Springville, UT (US) 84663

( * ) Notice: Subject to any disclaimer, the term of this patent is extended or adjusted under 35 U.S.C. 154(b) by 0 days.

(21) Appl. No.: 09/487,836

(22) Filed: Jan. 19, 2000

(51) Int. Cl.[7] ..... B07C 5/12
(52) U.S. Cl. ..... 209/680; 209/659
(58) Field of Search ..... 209/606, 629, 209/634, 659, 680

(56) References Cited

U.S. PATENT DOCUMENTS

| | | | | |
|---|---|---|---|---|
| 1,985,345 | * | 12/1934 | Gebhardt | 209/87 |
| 3,389,711 | | 6/1968 | Slayton . | |
| 3,389,790 | | 6/1968 | Braunheim et al. . | |
| 3,394,804 | | 7/1968 | Reichel . | |
| 3,545,613 | * | 12/1970 | Nystuen . | |
| 3,625,356 | | 12/1971 | Jackson . | |

* cited by examiner

*Primary Examiner*—Donald P. Walsh
*Assistant Examiner*—Mark J Beauchaine
(74) *Attorney, Agent, or Firm*—Thorpe North & Western, L.L.P.

(57) ABSTRACT

A utensil sorting apparatus simultaneously sorts and/or orients a plurality of utensils, such as spoons, forks, and knives. A first movable conveyor is movably disposed over a first template having at least one first aperture sized to receive therethrough only the spoons. The first conveyor sequentially moves the utensils through at least three locations, including a receiving location, a sorting and orienting location, and a discharge location. A bar may be disposed laterally across the first aperture in the first template at a location configured to correspond to a midpoint of the spoon. The center of gravity of the spoon causes the spoon to pass over one side of the bar to orient the spoon as it passes through the aperture. The apparatus has a first stage, including the first template and first conveyor, to separate the spoons, and a second stage, including a second template and a second conveyor, to separate the forks from the knives.

27 Claims, 5 Drawing Sheets

UTENSIL SORTING APPARATUS

BACKGROUND OF THE INVENTION

1. The Field of the Invention

The present invention relates generally to an apparatus for sorting utensils or silverware, such as spoons, forks and knives. More particularly, the present invention relates to a utensil sorting apparatus which continuously receives utensils, simultaneously sorts a plurality of the utensils, and simultaneously orients the utensils as they are sorted.

2. The Background Art

Large food preparation entities or eating establishments, such as restaurants, hotels, hospitals, cafeterias, etc., may serve hundreds to thousands of people per day or per meal. The large number of people served results in thousands of utensils or silverware which must be washed, sorted, and reoriented prior to reuse. These washing and sorting operations are typically performed by unskilled labor who collect the utensils, wash the utensils using either manual or large capacity washing machines, and then sort and orient the utensils. Because sorting the utensils requires the unskilled laborer to touch and handle the utensils, they must typically be rewashed to satisfy health and sanitation issues. One disadvantage with this system is the time and cost involved in unskilled labor manually sorting and orienting the utensils.

It is desirable to provide a system and/or apparatus for sorting and orienting utensils which is efficient and capable of rapidly sorting the utensils. It is also desirable that such a system or apparatus be accurate, simple, and sanitary.

A few different types of devices have been developed for sorting utensils. For example, U.S. Pat. No. 3,625,356 issued Dec. 7, 1979, to Jackson, discloses a device in which utensils pass through a chute with a twisted shape so that the utensils are caused to pivot about their lower end and swing outward towards a set of different height, gauged bars. The gauged bars are positioned at heights to allow shorter utensils to pass under the gauge bars while the higher gauge bars prevent longer utensils from passing underneath.

As another example, U.S. Pat. No. 3,389,790 issued Jun. 25, 1968 to Braunheim et al., discloses a device in which the utensils are disposed between partitions on the exterior of an angled drum. The drum rotates causing the utensils to rotate past a shield disposed about the lower portion of the drum. The shield is provided with three differently sized apertures for receiving three differently sized utensils as they are rotated past the apertures by the drum.

As another example, U.S. Pat. No. 3,545,613 issued Dec. 8, 1970, to Nystuen, discloses a device in which utensils are received between partitions on a conveyer belt. The conveyer belt moves the utensils past a plurality of different sized openings which are each sized to receive one of the utensils.

As another example, U.S. Pat. No. 3,389,711 issued Jun. 25, 1968, to Slayton, discloses a device with a plurality of open-ended pockets or tapered tubes which are rotated about a horizontal axis. The device has a first row of tapered tubes with an open bottom end sized to pass therethrough the narrowest utensils. As the tubes rotate about the horizontal axis, a utensil is disposed in each tube such that the narrowest utensil passes through the bottom of the tube while wider utensils will be trapped within the tube. As the tube rotates upwardly, it turns upside down such that wider utensils will fall out and be guided toward a next row of tapered tubes with wider openings.

One disadvantage with these types of devices is that they are designed to sort the utensils only one at a time. Thus, the utensils must be separated and fed into the devices one at a time, so that each utensil is disposed within a separate pocket or separate tube. In addition, the utensils are presented to a gauging opening one at a time.

Another disadvantage with these devices is that they only sort the utensils. Orientation of the utensils is performed as a separate step after sorting, if at all. Thus, after being sorted, some of the devices direct the utensils to other devices which are intended to orient the utensils in a common orientation.

Therefore, it would be advantageous to develop a method and/or apparatus for sorting a plurality of different utensils, which is simple, efficient, accurate, and sanitary. It would also be advantageous to develop such a method and/or apparatus which is capable of sorting a plurality of different utensils simultaneously. It would also be advantageous to develop such a method and/or apparatus which simultaneously sorts and orients the utensils.

OBJECTS AND SUMMARY OF THE INVENTION

It is therefore an object of the present invention to provide a method and/or apparatus for sorting a plurality of different utensils which is simple, efficient, accurate, and sanitary.

It is another object of the present invention to provide such a method and/or apparatus for sorting multiple utensils simultaneously.

It is yet another object of the present invention to provide a method and/or apparatus which sorts and orients the utensils simultaneously.

In accordance with one aspect of the present invention, the system includes a utensil sorting apparatus configured to simultaneously sort and/or orient a plurality of utensils. The plurality of utensils may include first utensils, such as spoons, second utensils, such as forks, and third utensils such as knives. The utensils preferably have different lengths.

The apparatus includes a first template having at least one first aperture sized to receive therethrough only the first utensils, or spoons. A first movable conveyor is movably disposed over the first template, and the at least one first aperture. The first conveyor sequentially moves the utensils through at least three locations. The first location is a receiving location to receive at least one of the first and second utensils. The second location is a sorting and orienting location to pass any first utensil through the aperture in the template, and to orient any first utensil passing through the aperture. The third location is a discharge location to discharge any second utensil.

In accordance with one aspect of the present invention, the first conveyor has a plurality of partitions formed thereon defining a plurality of pockets therebetween configured to receive the utensils. Each pocket has an opening movable across the first template, and the at least one first aperture. A flange is disposed on and extends outwardly from the template adjacent a side of the first aperture and at an end of the partitions to further define the pocket between the flange, the partitions, and the template. The flange extends laterally the length of the first and second locations, but leaves open the third location, such that any second or third utensil contained in the pocket may exit the pocket in the third location.

In accordance with another aspect of the present invention, a bar is disposed laterally across the first aperture in the template at a location configured to correspond to a midpoint of the first utensils, or spoon. Thus, the centers of gravity of the first utensils are disposed on either side of the bar as the first utensils are moved across the first aperture in the first template. Therefore, the first utensils tend to pass through the first aperture in the first template on a same side of the bar as the center of gravity, thus orienting the first utensils.

In accordance with another aspect of the present invention, the at least one first aperture includes a plurality of first apertures in the first template configured to simultaneously sort a plurality of the first utensils, or spoons.

In accordance with another aspect of the present invention, the apparatus has a first stage, comprising the first template and first conveyor, to separate the first utensils, or spoons. In addition the apparatus has a second stage, comprising a second template and a second conveyor, to separate the second utensils, or forks, from third utensils, or knives. The second template has at least one second aperture sized to receive therethrough the second utensils, or forks. The second movable conveyor is movably disposed over the second template and the at least one second aperture, and sequentially moves the utensils through at least three locations, including a receiving location, a sorting and orienting location, and a discharge location. A bar may be disposed laterally across the second aperture in the second template at a location configured to correspond to a midpoint of the second utensils, or forks.

In accordance with another aspect of the present invention, the templates are frusto-conical interior cores, and the conveyors are frusto-conical exterior shells, rotatably disposed on the respective cores.

In accordance with another aspect of the present invention, the first template may include at least one second aperture sized to receive therethrough the second utensils. Thus, the same template may be used to separate spoons and forks.

A method for sorting a plurality of utensils includes simultaneously receiving a plurality of utensils on a first movable conveyor. Each of the plurality of utensils are simultaneously moved past one of a plurality of first apertures in a first template by moving the first conveyor. The first apertures are sized to receive only the first utensils therethrough. Any remaining utensils, or second or third utensils, are simultaneously moved past the plurality of apertures and simultaneously removed from the first movable conveyor.

As indicated above, the utensils may be simultaneously received each into one of a first plurality of pockets on the first movable conveyor. Additional utensils may be simultaneously received each into one of a second plurality of pockets on the first movable conveyor while the first plurality of utensils are moved past one of a plurality of first apertures in a first template.

In addition, the first utensils may be simultaneously oriented while passing through the apertures. The plurality of utensils may be moved past a plurality of bars, each disposed over one of the first apertures at a location corresponding to a midpoint of the first utensils. A center of gravity of the first utensils causes them to pass through the apertures on a side of the bar corresponding to the center of gravity of the first utensils, thus orienting the first utensils.

Furthermore, any remaining second or third utensils may be simultaneously received on a second movable conveyor. The second and third utensils are simultaneously moved past one of a plurality of second apertures in a second template by moving the second conveyor. The second apertures are sized to receive only the second utensils.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION

Figure 1:
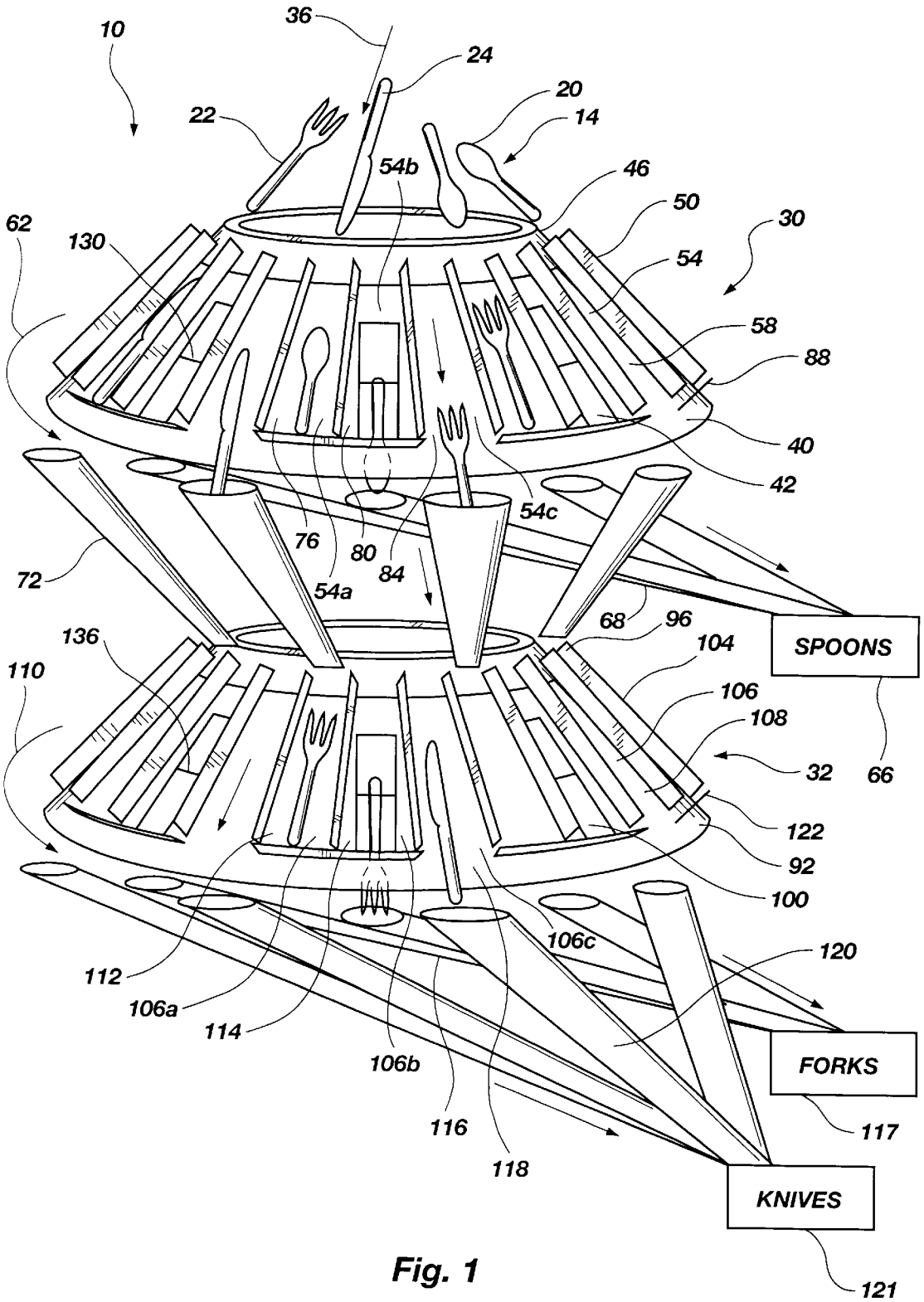
FIG. 1 is a perspective schematic view of a preferred embodiment of a utensil sorting apparatus in accordance with the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

Figure 2:
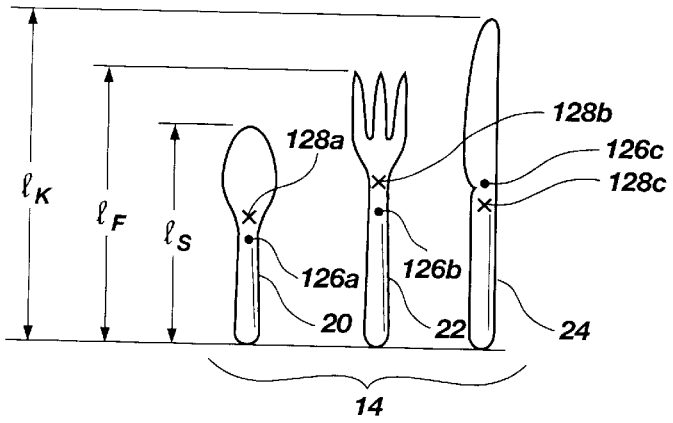
FIG. 2 is a side view of a preferred embodiment of utensils of the present invention.

As illustrated in FIG. 1, an apparatus, indicated generally at 10, in accordance with the present invention is shown for sorting and/or orienting a plurality of utensils, indicated generally at 14. Referring to FIG. 2, the utensils 14 may include: a first plurality of utensils or spoons 20; a different second plurality of utensils or forks 22; and a different third plurality of utensils or knives 24. The first utensils or spoons 20 may have a first, shorter length $l_S$; the second utensils or forks 22 may have a second, intermediate length $l_F$; and the third utensils or knives may have a third, longer length $l_K$. Although the present invention will be described with respect to knives, forks, and spoons with respective longer, intermediate, and shorter lengths, it will of course be understood that the apparatus 10 of the present invention may be configured to sort and/or orient any number of different utensils or instruments with varying dimensions.

Referring again to FIG. 1, the apparatus 10 includes: a first stage, indicated generally at 30, to separate the spoons 20 from the forks 22 and knives 24; and a separate, second stage, indicated generally at 32, to separate the forks 22 from the knives 24. The utensils 14 may be cleaned and separate prior to being sorted by the present apparatus 10. In accordance with one aspect of the present invention, the apparatus 10 advantageously sorts the plurality of utensils 14 simultaneously, rather than sorting individual utensils one at a time. The plurality of utensils 14 are received by the apparatus 10 as indicated by arrow 36, such as by chutes (not shown) or other means.

Figure 3:
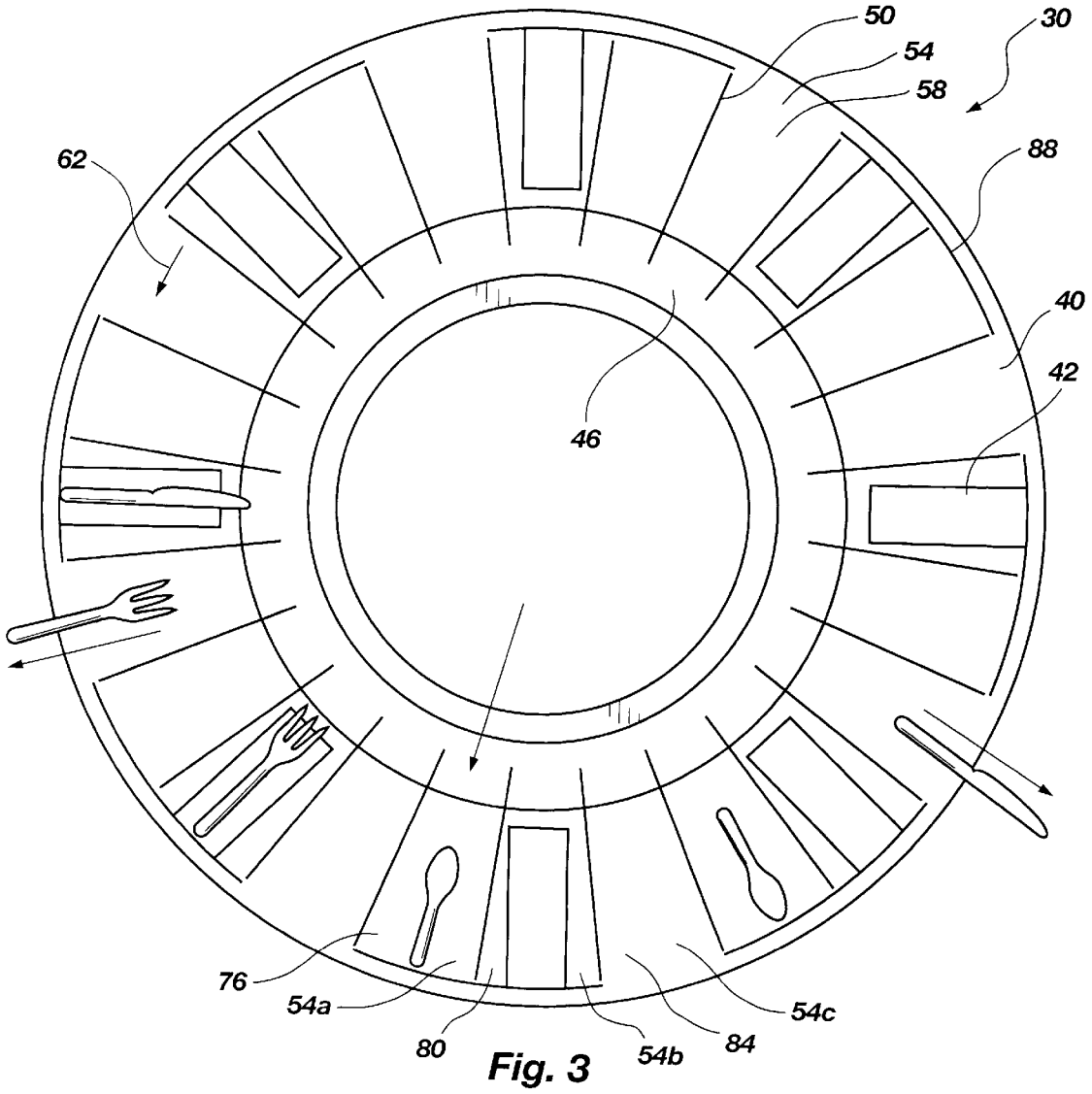
FIG. 3 is a top view of the preferred embodiment of the utensil sorting apparatus in accordance with the present invention.
Figure 4:
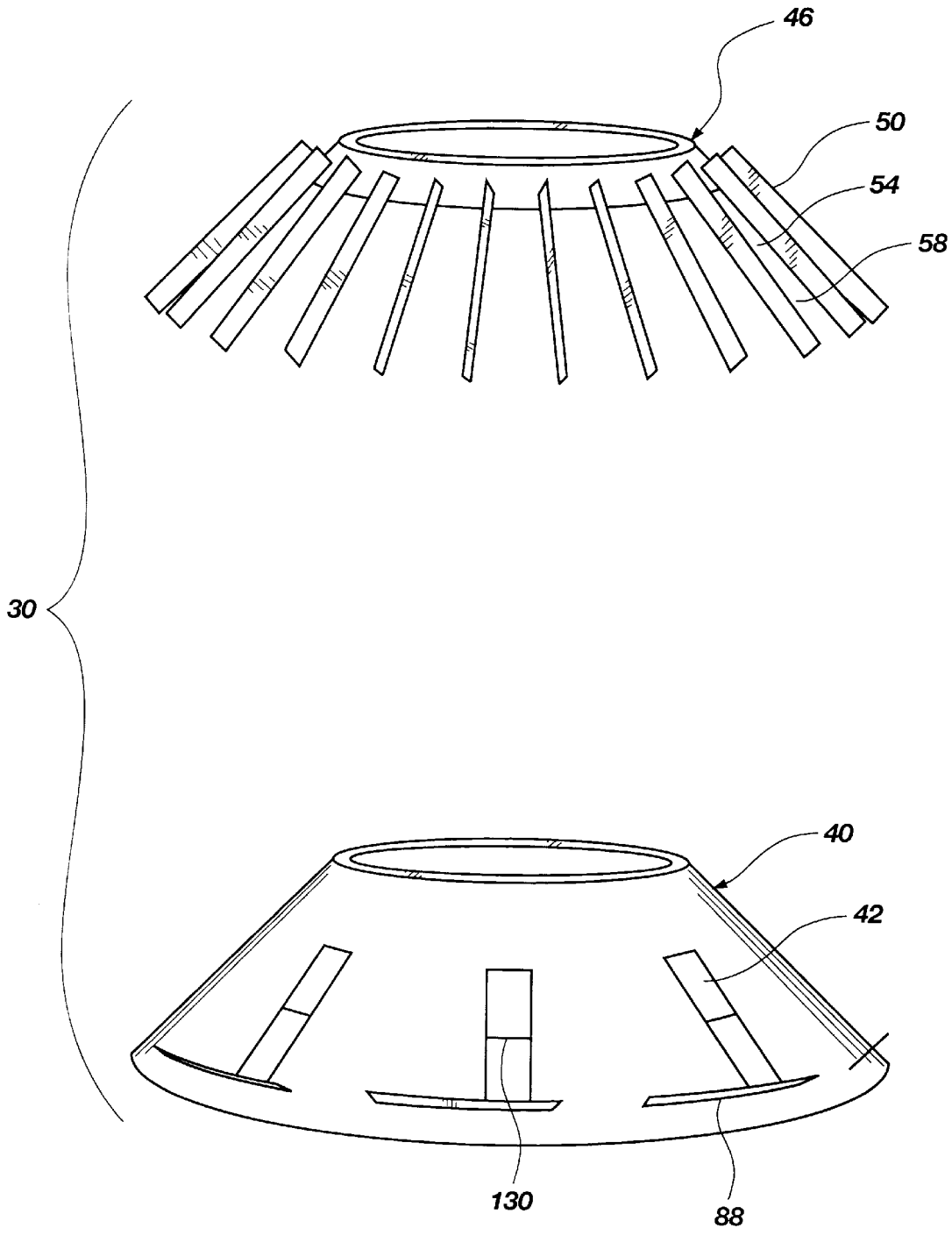
FIG. 4 is an exploded view of a preferred embodiment of a first stage of the utensil sorting apparatus in accordance with the present invention.

Referring to FIGS. 1, 3 and 4, the first stage 30 of the apparatus 10 includes a first template 40 having a plurality of first apertures 42. The first apertures 42 are sized and configured to receive therethrough only the spoons 20. Thus, the first apertures 42 may have a height or length which is slightly larger than the length $l_S$ of the spoons 20 so that the spoons 20 may pass through the first apertures 42. The first template 40 is configured to receive the utensils 14 thereon. Thus, the first template 40 preferably is angled or has an angled inclined surface. The first template 40 preferably and advantageously has a frusto-conical shape forming a frusto-conical interior core. The conical shape of the first template 40 advantageously provides an angled surface to receive the utensils 14 thereon. In addition, the conical shape of the first template 40 advantageously provides a narrow upper end where the utensils 14 can be received from a common area, as shown in FIG. 1. The angled surface of the first template 40 also allows utensils 14 to slide downwardly under the force of gravity, as will be discussed in greater detail below.

The first stage 30 also includes a first movable conveyer 46 movably disposed on the first template 40. The first conveyer 46 moves the utensils 14 across the template 40 and across the apertures. The first conveyer 46 preferably includes a plurality of partitions or vanes 50 which define a plurality of pockets 54 between the partitions to receive the utensils 14. The pockets 54 have openings 58 disposed adjacent to, or proximal, the first template 40. Thus, as the conveyer 46 moves on the template 40, the partitions 50, pockets 54, and openings 58 are also moved across the template 40 and the apertures 42.

The first conveyer 46 preferably and advantageously has a frusto-conical shape forming a frusto-conical exterior shell movably disposed on the frusto-conical interior core or template. In addition, the first conveyer 46 is rotatably disposed on the template 40, as indicated by arrow 62.

Referring to FIGS. 1 and 3, the utensils 14 are received at the upper ends of the first stage 30, or template 40, and conveyer 46. The utensils 14 slide under the force of gravity down the conveyer 46 and template 40 so that they are received in the open upper ends of the pockets 54. The utensils 14 continue to slide until they reach the bottom of the pockets 54. The conveyer 46 rotates 62 with the partitions 50 sliding the utensils 14 across the template 40 in a circular direction. The partitions 50 of the conveyer 46 continue to move the utensils 14 across the apertures 42. Because the spoons 20 are the same size or slightly smaller than the size of the openings 42, the spoons 20 pass through the openings 58 in the pockets 54 and through the apertures 42 in the template 40. The spoons 20 are gathered as they pass through the apertures 42 and may be directed towards a common spoon receptacle 66 by chutes 68, tubes or the like. Thus, the spoons 20 are separated from the forks 22 and knives 24. Because the forks 22 and knives 24 are longer than the apertures 42, they continue to pass over the apertures 42 as moved by the partitions 50. The forks 22 and knives 24 then pass out of the pockets 54 and are gathered, such as by chutes 72, and are directed to the second stage 32.

The conveyer 46 sequentially moves the pockets 54, and thus any utensils 14 contained therein, through at least three different locations. The first location is a receiving location 76 in which one or more utensils are received in the pockets 54. In the receiving location 76, the pocket 54*a* is disposed over the template 40 adjacent an aperture 42. The second location is a sorting and/or orienting location 80 in which any spoon 20 passes through the aperture 42 in the template 40. In addition, the spoon 20 preferably and advantageously is oriented simultaneously as it passes through the aperture 42, as discussed in greater detail below. In the sorting and orienting location 80, a pocket 54*b* is disposed over an aperture 42. The third location is a discharge location 84 in which any remaining utensil or fork 22 or knife 24 is discharged or removed from a pocket 54*c*. In the discharge location 84, the pocket 54*c* is disposed adjacent an opening opposite the receiving location 76.

Referring again to FIGS. 1, 3 and 4, the first stage 30 or template 40 includes a plurality of flanges 88 disposed on and extending outwardly from the template 40. Each flange 88 is disposed adjacent a lower side of the aperture 42 and at a lower end of the partitions 50. Thus, the flanges 88 act as the bottom of the pockets 54. As utensils 14 enter the pockets 54 and slide down the template 40, they are stopped by the flange 88. Thus, in the first location 76, the pocket 54*a* is defined by the partitions 50, the template 40, and the flange 88. As the conveyer 46 rotates, the partitions 50 slide the utensils 14 along the template 40 and the flange 88. Each flange 88 extends laterally the length of the first and second locations 76 and 80, but leaves open the third location 84. Thus, in the third location 84, the utensils may slide out of the pocket 54*c* under the force of gravity.

Referring to FIG. 1, the second stage 32 includes a second template 92 and second conveyer movably disposed on the second template 92. The second template 92 has a plurality of second apertures 100 which are sized and configured to receive therethrough only the forks 22. Thus, the second apertures 100 have a length of height which is the same as or slightly longer than the length $l_F$ of the forks 22.

The second stage 32 is similar in many respects to the third stage 30. The second conveyer 96 has a plurality of partitions 104 creating a plurality of pockets 106 with openings 108. The second template 92 and second conveyer 96 also may have a frusto-conical shapes defining a frusto-conical core and a frusto-conical interior shell. The second conveyer 96 is rotatably disposed on the second template 92, as indicated by arrow 110. Thus, the second conveyer 96 rotates, moving the partitions 104, pockets 106 and openings 108 across the second template 92 and across the second apertures 100.

The second conveyer 96 sequentially moves the pockets 106 and thus the utensils through three different locations, including a first location 112, or receiving location, where the forks 22 and knives 24 are received from chute 72 extending from the first stage 30. In the first location, the pocket 106*a* is disposed adjacent an aperture 100. In a second location 114, or receiving and orienting location, a pocket 106*b* is disposed over an aperture 100. Any fork 22 disposed in the pocket 106 passes through the aperture 100 and is collected, such as by chutes 116 extending to a fork receptacle 117, tubes, or the like. In the third location, or discharge location 118, any knives 24 remaining in the pocket 106*c* are discharged from the pocket and collected, such as by chutes 120 extending to a knife receptacle 121. The second stage 32 also has a plurality of flanges 122 extending from the second template 92, and extending across the first and second locations 112 and 114, but leaving the third location 118 open, such that knives 24 may slide out of the pocket 106*c* and be collected by the chute 120.

The first and second stages 30 and 32 may be vertically oriented with the second stage 32 located below the first stage 30. Thus, forks 22 and knives 24 leaving the first stage 30 may proceed through the chute 72 to the second stage 32 under the force of gravity.

As indicated above, the first stage 30 advantageously is configured to receive a plurality of utensils 14 simultaneously. In addition, the first template 40 advantageously has a plurality of first openings 42 so that the first stage 30 advantageously may sort the plurality of utensils simultaneously. The ability to simultaneously sort the plurality of utensils 14 provides a distinct advantage over prior art devices which are configured to sort utensils individually, or one at a time. In addition, the first stage 30 advantageously may continue to receive a plurality of utensils 14. For example, a first stage 30 may receive a first plurality of utensils 14 into the plurality of pockets 54*a* at a plurality of receiving locations 76. As the first conveyer 46 rotates 62, the first plurality of utensils 14 simultaneously are rotated from the first location 76 to the second or sorting location 80, where the first plurality of utensils 14 are simultaneously sorted. It will be appreciated that a second plurality of utensils may then be received in the pockets 54 at the plurality of receiving locations 76. Similarly, the second stage 32 simultaneously sorts a plurality of forks 22 and knives 24. The plurality of forks and knives 22 and 24 are received in a plurality of pockets 106*a* at the first or receiving location 112, the second conveyer 96 rotates 110 to simultaneously move the forks and knives 22 and 24 to the second or sorting location 114, where the forks 22 and knives 24 are simultaneously sorted. In addition, the second stage 32 can continuously receive a second plurality of forks and knives into the first receiving locations 112.

As indicated above, the utensils 14 may be oriented simultaneously as they are sorted, or as they pass through an aperture in a template. It will be appreciated that the utensils may be received by the apparatus 10, or first and second stages 30 and 32 in any orientation, such as pointing downward or pointing upward. The first stage 30 advantageously orients the spoons 20 simultaneously as they pass through the first aperture 42. Similarly, the second stage 32 simultaneously orients the forks 22 as they pass through the second apertures 100.

Referring again to FIG. 2, each utensil 14 has a center or midpoint, represented by a dot, and a center of gravity, represented by an x. It will be noted that the centers of gravity x of the utensils 14 do not coincide with the midpoints.

Figure 5:
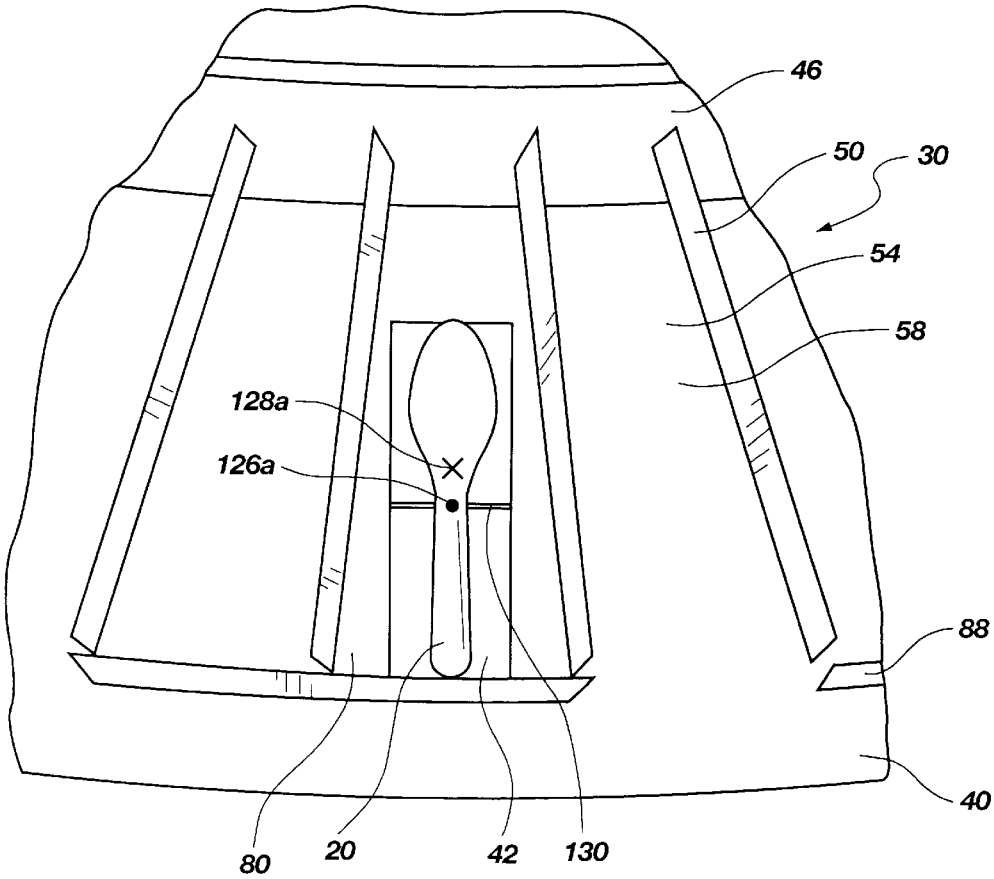
FIG. 5 is a partial side view of the preferred embodiment of the first stage of the utensil sorting apparatus in accordance with the present invention.

Referring to FIG. 5, a plurality of first bars 130 are each disposed laterally across one of the first apertures 42. The first bar 130 is located to correspond to the midpoint 126*a* of the spoon 20. Thus, the first bar 130 is disposed across the opening 42 generally at a midpoint of the length of the opening 42. Because the center of gravity 128*a* of the spoon 20 does not correspond with the midpoint 126*a,* the center of gravity 128*a* of the spoon 20 will be disposed on one side of the bar 130, or above or below the bar 130, as the spoon 20 is moved across the opening 42 by the conveyer 46. Because the template 40 and conveyer 36 are disposed at an angle, the spoon 20 is also disposed at an angle. Because the bar 130 is located at the midpoint 126*a* of the spoon 20, rather than the center of gravity 128*a,* the spoon 20 will not balance on the bar 130, but tend to pass through the aperture 42 on a same side of the bar 130 as the center of gravity 128*a*.

Figure 6:
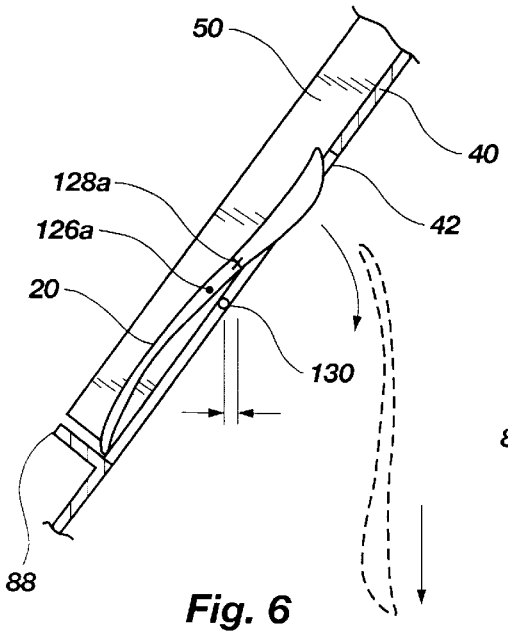
FIG. 6 is a partial cross-sectional view of the preferred embodiment of the first stage of the utensil sorting apparatus in accordance with the present invention.
Figure 7:
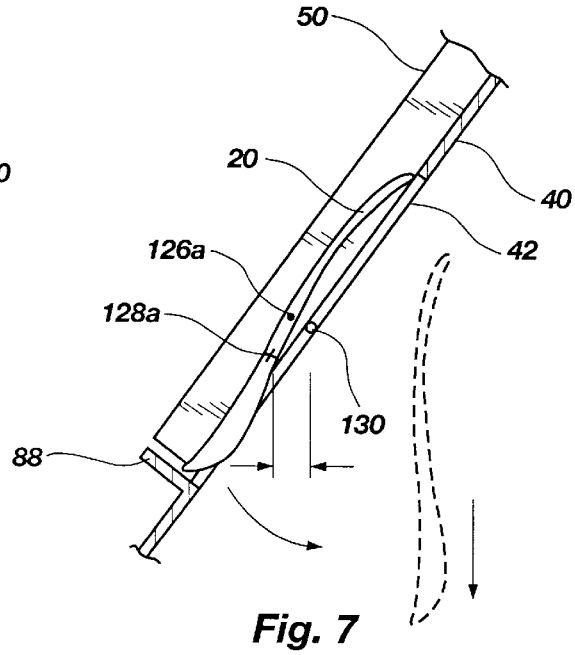
FIG. 7 is a partial cross-sectional view of the preferred embodiment of the first stage of the utensil sorting apparatus in accordance with the present invention.

Referring to FIG. 6, the spoon 20 is disposed upright, or to face or point upwardly. Thus, as the spoon 20 is moved across the opening 42, the center of gravity 128*a* is located above, and to one side of, the bar 130. Thus, the weight of the spoon 20 will tend to cause the spoon 20 to pass through the opening 42 above the bar 130, so that the spoon 20 pivots or rotates about the bar 130, so that the spoon 20 now points downwardly, as indicated by the dash lines. Referring to FIG. 7, if the spoon 20 is oriented to face or point downwardly, then the center of gravity 128*a* will be below, and to the other side of, the bar 130. Thus, as the spoon 20 passes over the aperture 42, the weight of the spoon 20 will tend to cause the spoon 20 to pass through the aperture 42 below the bar 130, thus causing the spoon 20 to pivot around the bar 130 so that the spoon is pointing downwardly, as shown by the dashed lines. Thus, regardless of how the spoon 20 is oriented as it passes over the aperture 42, the bar 130 and the center of gravity 128*a* of the spoon 20 cause the spoon 20 to pass through the aperture 42, and around the bar 130, in such a way that the spoon 20 will always be oriented to point or face downwardly after passing through the aperture 42. It will be appreciated that the above description with respect to the spoon applies equally to the fork 22 and knife 24.

Referring to FIG. 1, the second stage 32 similarly has a plurality of second bars 136 each disposed laterally across one of the second apertures 100 at a location configured to correspond to the midpoints 126*b* of the forks 22. Similarly, as the forks 22 are moved across the apertures 100, the centers of gravity 128*b* of the forks 22 are disposed above or below the second bar 136, tending to cause the forks 22 to pass through the aperture 100 above or below the bar 136 depending on the location of the center of gravity 128*b*. Thus, like the spoons 20, the forks 22 are oriented as they pass through the aperture 100 to face or point downwardly.

It will of course be understood that the knives 24 may be similarly passed across an aperture with a bar in order to orient the knives, similar to that described above for the spoons and forks.

Therefore, as indicated above, the spoons 20 and forks 22 are oriented simultaneously as they pass through their respective apertures so that the spoons and forks not only are separated from the plurality of utensils 14, but oriented to have a common orientation. Utilizing the apparatus 10 of the present invention to both sort and orient the utensils 14 provides a significant advantage over prior art devices, which use one structure or mechanism for sorting the utensils, and another structure or mechanism for then orienting the utensils, thus requiring additional space and structure.

It is of course understood that additional stages may be provided depending on the number of items to sort. For example, additional stages could be added to sort or separate soup spoons or salad forks, etc.

Figure 8:
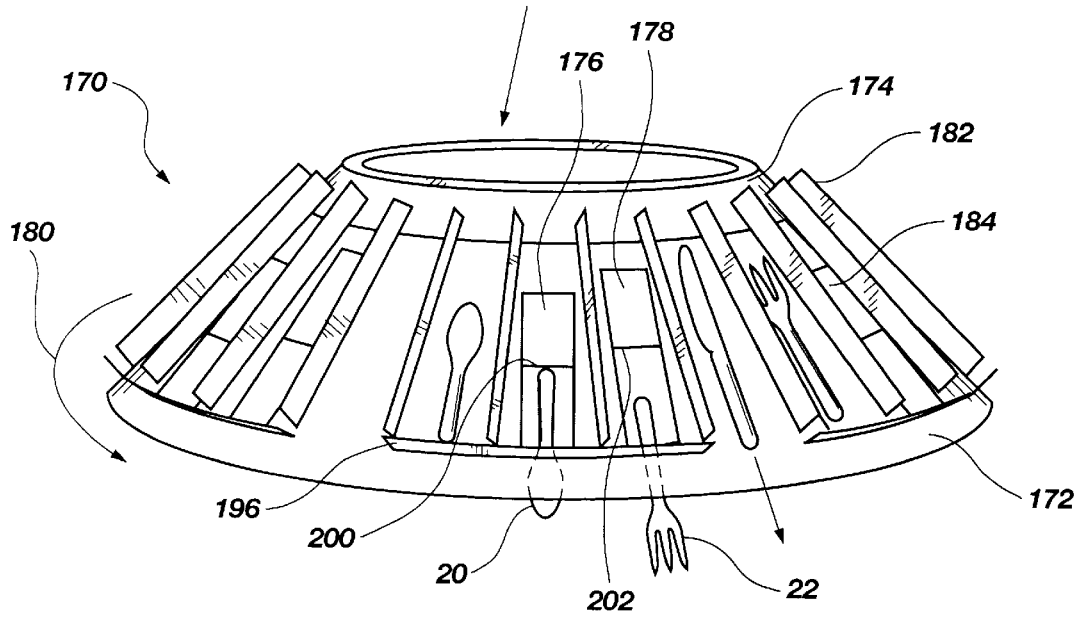
FIG. 8 is a perspective view of an alternative embodiment of a utensil sorting apparatus in accordance with the present invention.
Figure 9:
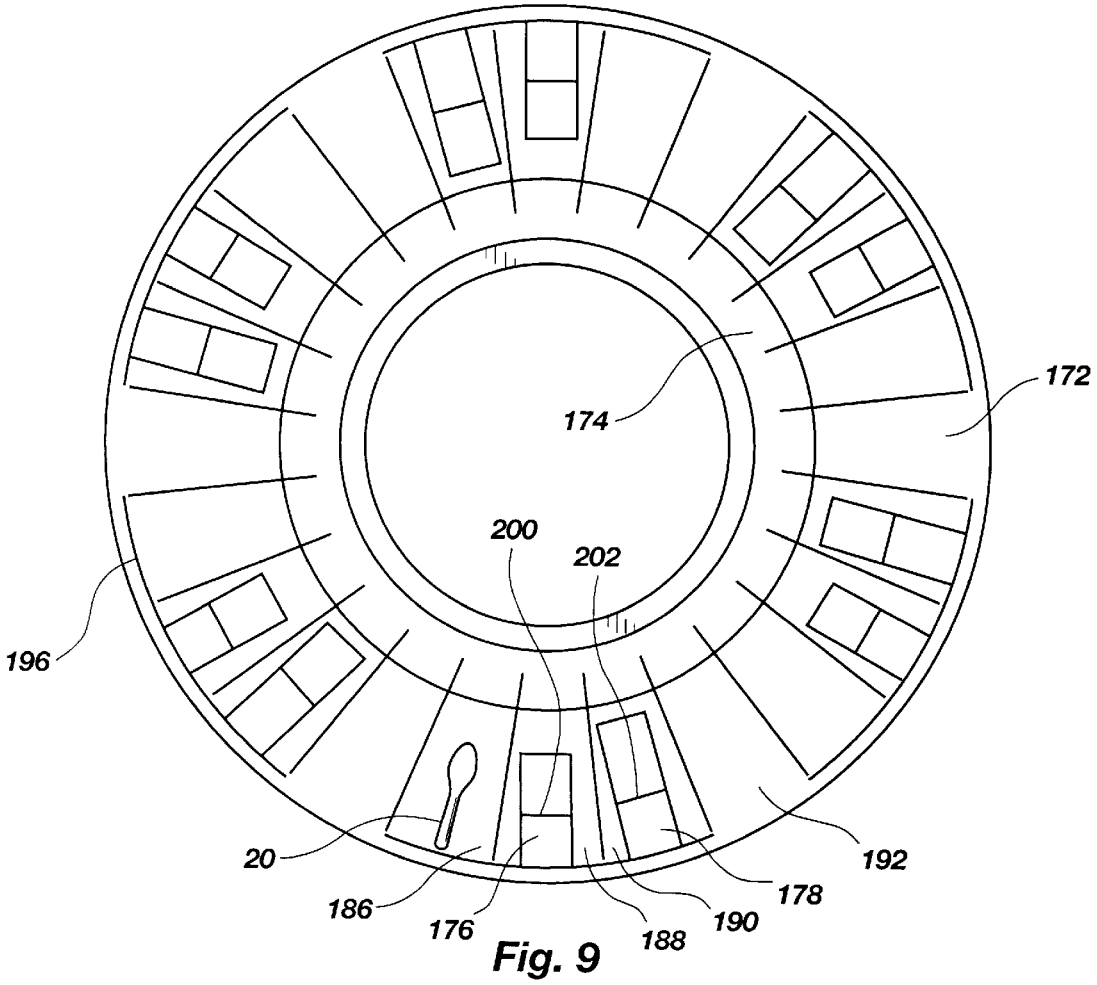
FIG. 9 is a top view of an alternative embodiment of a utensil sorting apparatus in accordance with the present invention.

Referring now to FIGS. 8 and 9, an alternative embodiment indicated generally at 170 is shown for sorting and/or orienting the plurality of utensils 14. The apparatus 170 is similar in many respects to the apparatus 10 described above. The apparatus 170 includes a template 172 and a conveyer 174 movably disposed on the template 172. The template 172, however, has a plurality of first apertures 176 sized to receive therethrough only the spoons 20, and a plurality of second apertures 178 sized and configured to receive therethrough only the forks 22. The first and second apertures 176 and 178 may be disposed adjacent one another. Thus, as the conveyer 172 rotates, indicated by arrow 180, the conveyer 178 moves the partitions 182, pockets 184 and utensils 14 sequentially through four different locations. In the first or receiving location, a pocket 184 is located adjacent the first aperture 176 to receive at least one of the plurality of utensils 14. The second location is a first sorting location 188 in which the pocket 184 and utensils 14 are disposed over the first aperture 176 to separate the spoons 20 from the remaining utensils 14. The third location is a second sorting location 190 in which the pocket 184 is disposed over the second aperture 178 such that any fork 22 passes through the aperture 178. The fourth location is a discharge location 192 in which any remaining knife 24 is discharged from the pocket 184. As described above, the apparatus 170 may have a plurality of flanges 196 disposed on the template 172 and extending across the first, second and third locations 186, 188, and 190, but leaving the fourth location 192 open for the discharging of knives.

As described above, the apparatus 170 advantageously receives a plurality of utensils and continuously sorts the plurality of utensils 14. In addition, the apparatus 170 separates both the spoons and the forks with single template 172 and conveyer 174, to reduce space.

It is of course understood that the apparatus 170 may be provided with collection chutes to collect the spoons, forks and knives as described above. In addition, the template 172 may be provided with a plurality of third apertures sized to receive the knives therethrough, which is similar to the first and second apertures 176 and 178.

Furthermore, a plurality of first and second bars 200 and 202 may be disposed across first and second apertures 176 and 178 as described above.

A method for sorting a plurality of utensils 14 using the apparatuses described above includes simultaneously receiving or providing the plurality of utensils 14 to a movable conveyer. The utensils may be received or provided to a first plurality of pockets formed in the movable conveyer. The plurality of utensils 14 are simultaneously moved past or across the apertures in the template by moving the conveyer. Simultaneously sorting a plurality of utensils provides a distinct advantage over prior art devices which individually provide and sort a utensil. Simultaneously sorting a plurality of utensils is faster and more efficient. Furthermore, after the conveyer has moved the first plurality of utensils over the apertures, a second plurality of utensils may be received simultaneously onto the conveyer, or onto a second plurality of pockets on the conveyer. Thus, the first plurality of utensils is being sorted while the second plurality of utensils are being received.

Any spoons are allowed to pass through the aperture in a template. Any remaining utensils such as forks or knives are simultaneously moved past the apertures, and simultaneously removed from the conveyer.

In addition, the plurality of utensils may be oriented simultaneously as they pass through the apertures. As indicated above, the plurality of utensils may be moved past a plurality of bars each disposed over one of the apertures at a location corresponding to the midpoints of the first utensils. The centers of gravity of the utensils are allowed to cause the utensils to pass through the apertures on one side of the bar due to the weight of the utensil, causing the utensils to have a common orientation.

Any remaining knives or forks may be received or provided simultaneously to a second movable conveyer which simultaneously moves the knives and forks past a plurality of second apertures or second template.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A utensil sorting apparatus configured to simultaneously sort and orient a plurality of utensils, including at least first and second different utensils, the apparatus comprising:

a) a template having at least one aperture sized to receive therethrough only the first utensils;

b) a movable conveyor, movably disposed over the template and the at least one aperture, to sequentially move the first and second utensils through at least three locations, including:

i) a receiving location to receive at least one of the first and second utensils;

ii) a sorting and orienting location to pass any first utensil through the aperture in the template, and configured to simultaneously orient any first utensil passing through the aperture; and iii) a discharge location to discharge any second utensil.

2. The apparatus of claim 1, wherein the conveyor has a plurality of partitions formed thereon defining a plurality of pockets therebetween configured to receive the first and second utensils, each pocket having an opening movable across the template and the at least one aperture; and wherein the pockets are sequentially movable through the at least three locations.

3. The apparatus of claim 2, further comprising:

a flange, disposed on and extending outwardly from the template adjacent a side of the aperture and at an end of the partitions, further defining the pocket between the flange, the partitions, and the template, the flange extending laterally the length of the first and second locations, but leaving open the third location, such that any second utensil contained in the pocket may exit the pocket in the third location.

4. The apparatus of claim 1, further comprising:

a bar, disposed laterally across the aperture in the template at a location configured to correspond to a midpoint of the first utensils, such that centers of gravity of the first utensils are disposed on either side of the bar as the first utensils are moved across the aperture in the template, tending to cause the first utensils to pass through the aperture in the template on a same side of the bar as the center of gravity, thus orienting the first utensils.

5. The apparatus of claim 1, further comprising a plurality of apertures in the template configured to simultaneously sort a plurality of utensils.

6. The apparatus of claim 1, wherein the template and the movable conveyor define a first stage configured to separate the first utensils; and further comprising a second stage configured to separate the second utensils from third utensils, the second stage including:

a) a second template having at least one aperture sized to receive therethrough the second utensils;

b) a second movable conveyor, movably disposed over the second template and the at least one aperture, to sequentially move the second and third utensils through at least three locations, including:

i) a receiving location to receive at least one of the second and third utensils;

ii) a sorting and orienting location to pass any second utensil through the aperture in the second template, and configured to simultaneously orient any second utensil passing through the aperture; and iii) a discharge location to discharge any third utensil.

7. The apparatus of claim 6, wherein the second conveyor has a plurality of partitions formed thereon defining a plurality of pockets therebetween configured to receive the second and third utensils, each pocket having an opening movable across the second template and the at least one aperture; and wherein the pockets are sequentially movable through the at least three locations.

8. The apparatus of claim 7, further comprising:

a second bar, disposed laterally across the aperture in the second template at a location configured to correspond to a midpoint of the second utensils, such that centers of gravity of the second utensils are disposed on either side of the second bar as the second utensils are moved across the aperture in the second template, tending to cause the second utensils to pass through the aperture in the template on a same side of the second bar as the center of gravity, thus orienting the second utensils.

9. The apparatus of claim 1, wherein the template is a frusto-conical interior core, and wherein the conveyor is a frusto-conical exterior shell, rotatably disposed on the core.

10. The apparatus of claim 1, wherein the template further includes at least a second aperture sized to receive therethrough the second utensils.

11. A utensil sorting apparatus configured for sorting a plurality of utensils, including knives, forks and spoons, the apparatus comprising:

a) a first stage configured to separate the spoons from the knives and forks, including:

i) a first template having at least one first aperture sized to receive therethrough only the spoons; and ii) a first movable conveyor, movably disposed over the template and the at least one first aperture, configured to move the utensils across the first aperture in the first template; and b) a separate second stage configured to separate the forks from the knives, including:

i) a second template having at least one second aperture sized to receive therethrough only the forks; and ii) a second movable conveyor, movably disposed over the second template and the at least one second aperture, configured to move the utensils across the second aperture in the second template.

12. The apparatus of claim 11, wherein the first conveyor has a plurality of partitions formed thereon defining at least one pocket therebetween configured to receive the utensils, the pocket having an opening movable across the first template and the at least one aperture, the first conveyor configured to move the pocket, and thus the utensils, across the aperture in the first template, such that any spoon in the pocket passes through the opening in the pocket and the aperture in the first template, thus separating the spoons from the knives and forks; and wherein the second conveyor has a plurality of partitions formed thereon defining at least one pocket therebetween configured to receive the utensils, the pocket having an opening movable across the second template and the at least one second aperture, the second conveyor configured to move the pocket, and thus the utensils, across the second aperture in the second template, such that any fork in the pocket passes through the opening in the pocket and the second aperture in the second template, thus separating the forks from the knives.

13. The apparatus of claim 11, wherein the first and second stages are vertically oriented with the second stage located beneath the first stage.

14. The apparatus of claim 11, wherein the first template is configured to simultaneously separate a plurality of spoons and has a plurality of apertures sized to receive therethrough only the spoons; and wherein the second template is configured to simultaneously separate a plurality of forks and has a plurality of second apertures sized to receive therethrough only the forks.

15. The apparatus of claim 11, further comprising:

a) a first bar, disposed laterally across the at least one aperture in the first template at a location configured to correspond to midpoints of the spoons, such that centers of gravity of the spoons are disposed on either side of the first bar as the spoons are moved across the aperture in the first template, tending to cause the spoons to pass through the aperture in the first template on a same side of the first bar as the center of gravity, thus orienting the spoons; and b) a second bar, disposed laterally across the at least one second aperture in the second template at a location configured to correspond to midpoints of the forks, such that centers of gravity of the forks are disposed on either side of the second bar as the forks are moved across the second aperture in the second template, tending to cause the forks to pass through the second aperture in the second template on a same side of the second bar as the center of gravity, thus orienting the forks.

16. The apparatus of claim 11, wherein the first and second templates are frusto-conical interior cores, and wherein the first and second conveyors are frusto-conical exterior shells, rotatably disposed on the respective first and second cores.

17. A utensil sorting apparatus for sorting utensils, including at least first and second utensils, the apparatus comprising:

a) a template having (i) a plurality of first apertures sized to receive therethrough only the first utensils, and (ii) a plurality of second apertures sized to receive therethrough only the second utensils; and b) a movable conveyor, movably disposed across the template and the first and second apertures, configured to move the first and second utensils across the first and second apertures in the template, and sequentially through at least three locations, including:

i) a receiving location to receive at least one of the first and second utensils;

ii) a first sorting location to pass and orient any first utensil through the first aperture in the template; and iii) a second sorting location to pass and orient any second utensil through the second aperture in the template.

18. The apparatus of claim 17, wherein the conveyor has a plurality of partitions formed thereon defining a plurality of pockets therebetween configured to receive the first and second utensils, each pocket having an opening movable across the template and the first and second apertures.

19. The apparatus of claim 18, further comprising:

a plurality of bars, each disposed laterally across one of the first and second apertures in the template at a location configured to correspond to midpoints of the respective first and second utensils, such that centers of gravity of the first and second utensils are disposed on either side of the respective bar as the first and second utensils are moved across the respective first and second apertures in the template, tending to cause the first and second utensils to pass through the respective first and second apertures in the template on a same side of the respective bar as the center of gravity, thus orienting the first and second utensils.

20. The apparatus of claim 17, wherein the template is a frusto-conical interior core, and wherein the conveyor is a frusto-conical exterior shell, rotatably disposed on the core.

21. A method for sorting a plurality of utensils, including at least first and second utensils, the method comprising the steps of:

a) simultaneously receiving a plurality of utensils on a movable conveyor;

b) simultaneously moving each of the plurality of utensils past one of a plurality of apertures in a template by moving the conveyor, the apertures being sized to receive only the first utensils;

c) simultaneously moving any remaining second utensils past the plurality of apertures; and d) simultaneously removing any remaining second utensils from the movable conveyor.

22. The method of claim 21, wherein step a) further comprises simultaneously receiving the plurality of utensils each into one of a first plurality of pockets on the movable conveyor.

23. The method of claim 22, wherein step b) further comprises simultaneously receiving an additional plurality of utensils each into one of a second plurality of pockets on the movable conveyor.

24. The method of claim 21, wherein step b) further comprises simultaneously orienting the first utensils while the first utensils pass through the apertures.

25. The method of claim 24, further comprising moving the plurality of utensils past a plurality of bars each disposed over one of the apertures at a location corresponding to midpoints of the first utensils; and allowing centers of gravity of the first utensils to cause the first utensils to pass through the apertures on a side of the bar corresponding to the centers of gravity of the first utensils, thus orienting the first utensils.

26. The method of claim 21, further comprising:

e) simultaneously receiving any remaining second utensils and any remaining third utensils on a second movable conveyor;

f) simultaneously moving each of the second and third utensils past one of a plurality of apertures in a second template by moving the second conveyor, the apertures being sized to receive only the second utensils.

27. The method of claim 21, wherein the template is a frusto-conical interior core, and wherein the conveyor is a frusto-conical exterior shell, rotatably disposed on the core.

* * * * *